United States Patent [19]

Couture et al.

[11] 4,422,383

[45] Dec. 27, 1983

[54] PERIPHERAL BURNING INCENDIARY DEVICE

[75] Inventors: Joseph E. G. Couture, St-Augustin; Philip A. Twardawa, Shannon, both of Calif.

[73] Assignee: Her Majesty the Queen in right of Canada, as represented by the Minister of National Defence, Ottawa, Canada

[21] Appl. No.: 284,819

[22] Filed: Oct. 14, 1981

[30] Foreign Application Priority Data

Dec. 2, 1980 [CA] Canada ..... 365909

[51] Int. Cl.[3] ..... F42B 25/14; F42B 27/04

[52] U.S. Cl. ..... 102/364

[58] Field of Search ..... 102/364, 341

[56] References Cited

U.S. PATENT DOCUMENTS

| | | | |
|---|---|---|---|
| 3,669,020 | 6/1972 | Waite et al. | 102/364 |
| 3,889,601 | 6/1975 | Koehne | 102/364 |
| 4,060,435 | 11/1977 | Schroeder | 102/364 |
| 4,365,557 | 12/1982 | Couture et al. | 102/364 |

*Primary Examiner*—Charles T. Jordan

*Attorney, Agent, or Firm*—Cushman, Darby & Cushman

[57] ABSTRACT

The invention disclosed is a floating incendiary device adapted to be dropped from an aircraft onto a combustible material on a body of water. The device includes an incendiary composition in the form of a disc which is ignited peripherally and burns inwardly. The incendiary composition is sandwiched between a pair of discs which direct the resulting flame radially outwardly over the surface of the combustible material during the burn time of the incendiary composition for a time sufficient to raise the temperature of the combustible material to its fire point to produce ignition and selfsustaining combustion of the combustible material.

12 Claims, 2 Drawing Figures

PERIPHERAL BURNING INCENDIARY DEVICE

This invention relates to a floating incendiary device for igniting combustible material on the surface of a body of water.

Hydrocarbon slicks floating on water, resulting from such occurrences as subsea oil well blowouts and shipping accidents, are catastrophic for the affected marine environment. With increasing numbers of subsea exploratory and production oil wells, and an increasing volume of shipping traffic relying on progressively larger tankers, disastrous contamination of the environment is not only possible but probable. The situation is further aggravated by exploratory wells and shipping steadily moving northward into perilous, ice-infested waters.

To date no efficient method for the cleanup of these slicks exists. While containment and/or recovery techniques have a limited application under certain ideal conditions, a large-scale spill on the open seas generally precludes their use. In the north the remoteness and hazardous ice conditions further discourage operators from attempting clean-up.

What is undoubtedly the most practical solution, if not the only solution, to the disposal of many of these spills is their in situ combustion. While often looked on as a "last resort option" in that the smoke and residual sludge resulting from a burn themselves contribute to the pollution of the environment, the overall polluting effect can be reduced by as much as 90%.

In the North, the remoteness of the location and the dangers brought about by the presence of ice further support the employment of in situ combustion. in the typical oilspill scenario it is conceivable that a blowout could occur near the end of the drilling season, and the forthcoming freeze-up would force the operator to abandon the site before capping the well. In this case, the blowout would run wild until capped the next drilling season. It is popularly hypothesized that in this interium the crude oil would accumulate under the ice cover, spreading out as dictated by surface ocean currents, until the spring thaw at which time it would percolate up through brine channels in an essentially unweathered state. This crude would then form slicks on literally thousands of melt pools extending over a narrow corridor but strung out over possibly 1000 km. Owing to the vastness of the affected area, the precarious nature of the ice cover, and the remoteness of the spill site, it would be technically impossible to move men and equipment onto the ice surface to effect a cleanup. Quite understandably the only viable solution to its disposal is in situ combustion, where each slick would have to be separately ignited by incendiary devices dropped from low flying aircraft.

The major problem associated with in situ combustion is, however, that to date there just is no reliable and practical method of igniting these slicks, be they in the North or in more southern shipping lanes. Although the slicks consist of volatile hydrocarbons, and they burn vigorously when lit, their actual ignition is deceptively difficult. The problem is created by the slick thinning out to the point where the heat energy input to initiate combustion is lost to the underlying water (which serves as an infinite heat sink) rather than conserved within the slick to raise its local temperature to the fire point. The problem is further aggravated by the chemical degradation (weathering) of the slick which tends to remove or isolate the more volatile components, raising its fire point and hence making its ignition substantially more difficult. Finally the problem can be taken one step further if one is to adopt the Arctic melt pool scenario as described previously. In this situation there may conceivably be thousands of small slicks in melt pools that must be individually lit over a short time period, in a very treacherous and remote environment.

At present, there is a very limited selection of incendiary devices on the market that have been designed specifically for the ignition of hydrocarbon slicks. One such device is known by the trade name of Kontax marketed by Scheidemandel A. S., Hamburg, West Germany. It consists essentially of a cylinder filled with calcium carbide and incorporating a sodium metal bar in the center. Upon contact with water, the sodium reacts to produce burning hydrogen gas and the calcium carbide reacts to produce acetylene gas, which is ignited by the hydrogen and in turn ignites the crude oil. Some success has been achieved using this device, but in practice the production of calcium hydroxide foam isolates the device from the crude oil and any possibility for ignition is largely impaired.

Other incendiary devices that have been used include napalm, a gasoline gel with a white phosphorus igniter set off by a burster fuse. The burster fuse, when fired, spreads the gel and burning phosphorus over a large area. Of similar operation are firebomb igniter devices consisting of a combustible metal and a fluoroalkylene polymer eg. magnesium metal and polytetrafluoroethylene (Teflon®) as described in U.S. Pat. No. 3,669,020 which issued June 13, 1972 to H. Waite et al. In this particular magnesium-Teflon® igniter, a burster fuse disseminates small burning particles that continue to burn for several seconds and provide ignition points for areas of fuel concentration. The failure of these devices is that the hot spots produced are too small and of too short a duration to enable self-propagation of a flame and sustained combustion in all but the most volatile and concentrated slicks.

As mentioned earlier, the main problem with the available commercial igniters is that none of them have been tailor-made exclusively for the ignition of low-volatile hydrocarbon slicks and in Arctic conditions. Both the magnesium-Teflon® igniter of the above mentioned U.S. Pat. No. 3,669,020 and napalm suffer from the drawback that they produce heat for only several seconds, whereas the preheat time for a thin slick would have to be in the order of minutes with an igniter having this radiant heat flux. Similar is the case with thermite (a mixture of ferric oxide and powdered aluminum, usually enclosed in a metal cylinder and used as an incendiary bomb) which, although burning very hot, is consumed very rapidly with the result that there is little overall heat transfer to the slick.

Priming a slick with large quantities of a more volatile fuel and adding rags, straw, and commercial wicking agents in copious amounts may eventually help to get the slick burning, but clearly thus is not the most practical approach either. If one considers again the Arctic melt pool scenario, the sheer size of the possible contaminated area and the huge numbers of oiled melt pools demand that the incendiary device be much more versatile i.e. it must be small, lightweight, and quickly deployable in order to permit its being dropped from low flying aircraft.

Finally, none of the incendiary devices examined thus far are efficient in their operation. While most generate sufficient heat to raise enough of the slick to its fire point so that a self-sustaining combustion could be achieved, in all cases the major proportion of the generated heat is lost to the atmosphere with the result that in most cases no ignition takes place. The size and mass constraints imposed by the Arctic scenario demand that the incendiary device be efficient in its operation: a large proportion of the heat it produces must be used to heat the slick, with relatively little lost to the air.

One device which has been found to be suitable is the device described in applicant's U.S. Pat. No. 4,365,557. That device acquires its high efficiency at the expense of an assembly of sophisticated and somewhat expensive components. It is designed to float and operate in a vertical position and being a cigarette-type burner the flames are oriented upwards. To direct the hot gases over the surface of the oil to be ignited, the device relies on a separate flame/heat deflector to redirect this emitted heat. To hold the deflector, a resistant casing must be used, further increasing the inert mass fraction of the device. It is therefore an object of the invention to provide a simplified floating incendiary device which does not require a separate deflector and interior or exterior casing.

According to one aspect of the invention, a floating incendiary device for igniting a combustible material on the surface of a body of water is provided comprising an incendiary composition; flotation means for maintaining the incendiary composition above the surface of the water; firing means for igniting the incendiary composition peripherally so that the incendiary composition burns inwardly; and directing means for directing the resulting flame radially outwardly over the surface of the combustible material during the burn time of the incendiary composition.

In the drawing which serves to illustrate embodiments of the invention,

Figure 1:
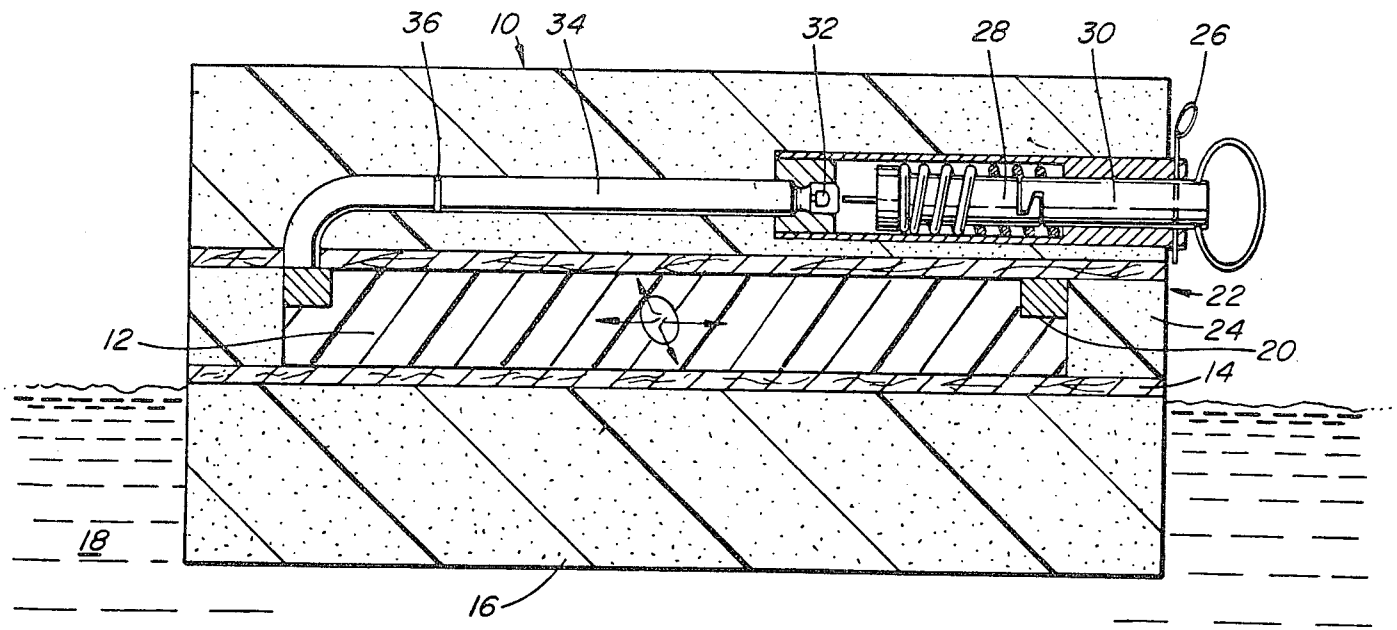
FIG. 1 is a side elevation in section of the novel incendiary device according to the invention.

Referring to the figure, the incendiary device 10 is seen to comprise an incendiary composition 12. Flotation means 16 is provided to maintain the incendiary composition above the surface of the water 18. Firing means is provided for igniting the incendiary composition at its periphery to permit inward burning of the incendiary composition. Directing means 14 is provided for directing the resulting flame radially outwardly over the surface of the combustible material during the burn time of the incendiary composition.

More specifically, the incendiary composition 12 is in the form of a disc 20 to 25 cm in diameter by 2.5 cm thick. In order to facilitate mass production, discs of incendiary composition can be individually molded to the appropriate shape in molds or can alternatively be produced in the form of cylinders which, following curing, can be sliced into discs of the required thickness.

The incendiary disc burns inwardly from the peripheral surface, the resulting flames being projected radially outwardly. The composition burns inward at a rate of about 5 cm/min to provide a burn of up to 2 minutes duration.

The incendiary composition may be the same as that described in applicant's U.S. Pat. No. 4,365,557. Bearing some resemblance to a solid rocket motor propellant, the proportions of ingredients have been altered and others added to yield the very desirable properties of a steady, controlled slow combustion (4–7 cm/minute) while at the same time providing a very high flame temperature (1450°–2300° C.) and a large radiant heat flux. The formulation of the incendiary composition is typically in the neighbourhood of 40–70%/w ammonium perchlorate oxidizer, 10–30%/w solid metal fuel, preferably magnesium or aluminum, and 14–22% binder as described in more detail below. In addition small amounts of other ingredients, including thickeners such as dextrin and Cab-O-Sil (a trademark for colloidal silica particles sintered together in chain-like formations), are generally present in the incendiary composition. These provide a very finely-ground silica which is required to increase the viscosity of the formulation during the casting process and prevent any stratification or sedimentation of ingredients at the curing stage. In this manner the compositions are easily processed by standard propellant-industry equipment (or even less specialized equipment) and behave well in casting, and hence are well suited for this application.

A preferred binder in the incendiary composition of the present invention is based on an hydroxyl-terminated polybutadiene polymer, such as the poly BD® R-45HT manufactured by Arco Chemical Company, cured with a commercial diisocyanate such as DDI®-1410 marketed by General Mills or any other suitable isocyanate. The binder is preferably plasticized with from 20 to 30% by weight of an ester such as isodecyl pelargonate (IDP). Other additives might be present in the binder in order to improve the mix viscosity and the strength and elongation of the binder.

In further explanation of the incendiary composition, there are presented below specific examples and burn characteristics of said compositions. In these examples, as throughout the description, all percentages are by weight unless otherwise specified.

A formulation comprising 55% ammonium perchlorate, 30% aluminium and 15% binder resulted in a burn rate of 5.6 cm/min with a flame temperature of 2250° C. A similar composition consisting of 60% ammonium perchlorate, 20% aluminium and 20% binder clearly shows the effect of the increased proportion of binder with a slower burning rate of 4.5 cm/min and a much cooler flame temperature, 1450° C. Both compositions yield a columnar stream of sparks during combustion, providing a very intense source of heat.

Using magnesium as the fuel, burning rates and flame temperatures tend both to be higher, with fewer sparks emmanating in a more dispersed fashion. A mixture of 57% ammonium perchlorate, 25% magnesium and 18% binder provides for a burn rate of 6.5 cm/min and a flame temperature of 2350° C. A slight increase in oxidizer content to 62% ammonium perchlorate and corresponding decrease in fuel content with 20% magnesium, with the 18% binder content remaining the same, slows down the burn rate slightly to 6.0 cm/min at the same flame temperature of 2350° C.

A composition which is particularly suited to the novel device claimed herein is a formulation comprising 56%/w ammonium perchlorate, 25%/w aluminum, 18%/w of binder (poly BD® R-45HT manufactured by ARCO Chemical Company, cured with a diisocyanate, DDI®-1410 manufactured by General Mills) and 1%/w of Thixcin®-E, a thixotropic agent. This composition provided for a flame temperature of 1800° C. and a burn rate of 4.5 cm/min.

Directing means 14 is in the form of a pair of discs of larger diameter than the incendiary disc 12 which retain the incendiary composition therebetween in the form of a sandwich. The discs are made of a suitable material which prevents premature melting or burning of the flotation means 16 and is sufficiently fire-proof that during the burn time of the incendiary composition it maintains its structural integrity such that as the incendiary composition is consumed and burns inwardly, the retaining means serves to direct the flame radially outwardly over the surface of the combustible material. The incendiary disc 12 and plywood discs 14 are co-axially aligned to define an annular recess 22. Discs of 6 mm thick plywood have produced satisfactory results. This material also provides a certain amount of flotation capability. The plywood discs 14 are bonded to the incendiary disc 12 by means of a suitable adhesive, conveniently with a similar binder to that used in the incendiary composition.

Flotation means 16 is conveniently in the form of a pair of cylindrical foam blocks of the same diameter as discs 12 and 14. Light-weight polystyrene foam has been found acceptable. The foam blocks are bonded to the exposed faces of discs 14 by a suitable commercial adhesive.

It is indicated above that polystyrene is the preferred foam material for the flotation means. Other types of foam such as polyurethane could be used and would work well as long as the buoyancy and shock protection is maintained but polystyrene has the advantage of being readily combustible and will leave much less residue than a polyurethane foam.

In addition to providing for adequate buoyancy, the foam blocks provide physical protection for the device to absorb the landing shock at impact following air-deployment. Additional shock absorption and buoyancy are provided by an annular flotation ring 24 which fills recess 22 and creates a virtual shock absorbing envelope around the device 10. The annular foam block 24 will actually be consumed very shortly after ignition, otherwise it would restrict the peripheral emission of the flames.

The firing means includes ignition composition 20 in the form of an annular ring disposed in a recess in and surrounding the incendiary disc 12. Ignition composition 20 is fast burning and thus ignites the entire peripheral surface of disc 12 within a few seconds. It is vulcanized onto the incendiary disc 12 and covered with adhesive tape.

Figure 2:
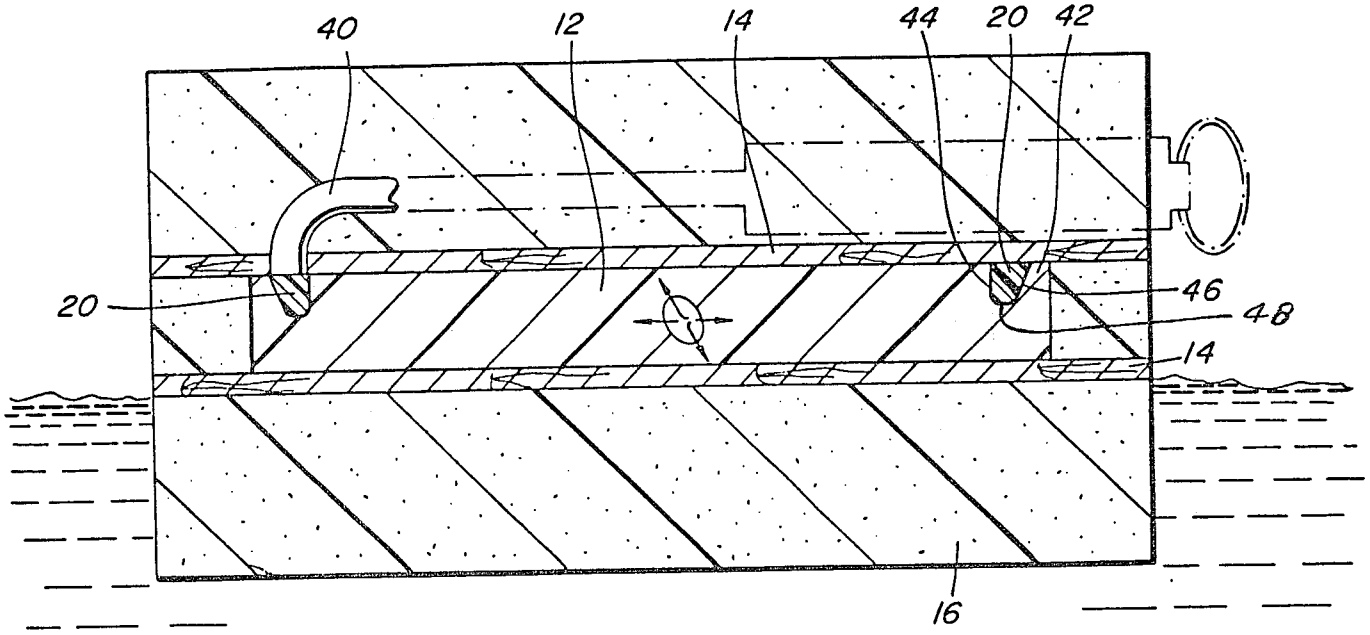
FIG. 2 is a side elevation in section illustrating another embodiment.

As seen in FIG. 2, the ignition composition 20 may be provided in a groove machined in the incendiary composition disc 12. The main advantage of this arrangement are that a shoulder 42 of incendiary composition provides additional protection against displacement of the ignition composition 20, and that the ignition composition may be inserted into the groove in the form of a paste in a suitable volatile solvent, which evaporates upon room temperature curing. Also, there is no need to tape the ignition composition in place. In spite of the additional machining required to form the groove, this is the preferred arrangement. The groove is defined by an inner vertical edge 44 an outer edge 46 at about 27° to the vertical and a curved bottom portion 48. The largest diameter of the groove is about 0.25 inches and its depth is about 0.30 inches.

The ignition composition is a fast burning composition, that yields a hot flame. In the preferred formulation it is prepared with 80 to 85%/wt of F-ND®, a boron potassium nitrate granular ignition material (or standard black powder, a mixture of 20 parts of fine grade type F and 40 parts of coarse type FFF) and 15 to 20% of binder. The binder is formulated with 85%/wt of an epoxy resin Epon® 815 marketed by Shell Co. and 15%/wt of HYSOL® 3543, an amine type curative, sold by HYSOL Chemical Co. A preferred binder is based on an hydroxyl-terminated polybutadiene based polymer, such as the Poly BD® R-45HT manufactured by ARCO Chemical Co., cured with a commercial diisocyanate such as DDI®-1410 marketed by General Mills.

The ignition of the incendiary composition is now described in relation to the operation of the firing means. A pyrotechnic delay igniter is employed to activate the device. In this case, at the moment of deployment from the aircraft, a safety pin 26 is pulled and a sprung striker 28 is armed and released by pulling on a firing clip 30. The striker 28 initiates a small 9-mm primer cap 32 which in turn activates burning of the delay fuse column 34. The latter burns at a rate of about 0.5 cm/sec, and thus after approximately a 20-second delay the burn reaches the end of the delay column and ignites the transfer/igniter powder 36. A curved copper tube 40 is used to direct the hot blast from the igniter powder 36 to the ignition composition 20 and finally initiate the incendiary composition 12. This pyrotechnic delay igniter is of similar design as those commonly employed in conventional hand grenades excepting certain hardware changes and lengthening of the delay column. The delay is mainly for safety purposes to permit sufficient release time, and to permit the device to self-right and allow water surface conditions to recover from rotor downwash effects if the aircraft employed is a helicopter.

Since the delay column is gasless, there is no resultant pressure buildup during the course of its burn and hence this delay column is suitable for such a confined location. Accidental firing of the igniter is eliminated by the presence of the safety pin. Furthermore, becaue the striker is unarmed until moment of deployment (the spring has no tension applied) and because it is held away from the primer cap by the firing clip, the possibility of activation of the delay igniter by vibration is virtually eliminated. The safety features and long delay inherent in this delay igniter make it very suitable for its deployment from aircraft.

A further advantage of this alternate method of floatation is the scuttling ability. As the incendiary composition nears burnout, it tends to burn through the thin plywood discs 14 and consume the foam blocks 16. Thus, the entire device with the exception of the pyrotechnic delay igniter will burn. Only the delay igniter sinks, thus minimizing any harmful effect of its presence in the environment.

Another feature of the design of the incendiary device is that it will naturally end up and maintain the desired stable orientation on the water, since it cannot stand on end on the water surface because of a slightly uneven weight distribution, and is operable regardless of which major surface faces up.

Consisting uniquely of proven-reliable ingredients and components, the incendiary device can be expected to have a long storage life, in the order of 10 years at temperatures ranging from −50° C. to +50° C. A typical device according to the invention has a unit mass of about 2.27 kg. 100 units and the associated containers occupy a storage space of the order of 0.75 m wide by 1 m long and 1.3 m high. The device is light enough to float freely in as little as 5 cm of fresh water.

Tailoring of this device to fulfill the requirement imposed by the Arctic melt pool scenario, typically spills of low-volatile hydrocarbons, does not in any way preclude its use on other crude oil spillages. Since the incendiary device is capable of igniting slicks that are at the lower limit of combustibility, regardless of their size, the device will be equally effective in more southern climates on open-sea slicks resulting from accidental spillages, providing that they are combustible.

We claim:

1. A floating incendiary device for igniting a combustible material on the surface of a body of water, comprising an incendiary composition;

flotation means for maintaining the incendiary composition above the surface of the water;

firing means for igniting the incendiary composition peripherally so that the incendiary composition burns inwardly; and directing means for directing the resulting flame radially outwardly over the surface of the combustible material during the burn time of the incendiary composition.

2. A floating incendiary device according to claim 1, wherein said incendiary composition is in the form of a disc.

3. A floating incendiary composition according to claim 2, wherein said directing means is in the form of a pair of discs of a suitable material and of slightly larger diameter than said incendiary disc, bonded to and retaining said incendiary disc therebetween, said incendiary disc and retaining discs being co-axially aligned.

4. A floating incendiary composition according to claim 3, wherein said flotation means is in the form of a pair of cylindrical foam blocks of the same diameter as said pair of discs bonded to the exposed major surfaces of said retaining discs.

5. A floating incendiary device according to claim 1, 3 or 4, wherein said incendiary composition has a burn time of about 2–2½ minutes at a temperature in the range of 1450° to 2300° C.

6. A floating incendiary device according to claim 1, 3 or 4, wherein said incendiary composition comprises in terms of percent by weight, ammonium perchlorate: 40–70 a fuel selected from magnesium and aluminum: 10–30 an hydroxy-terminated polybutadiene based binder: 14–22

7. A floating incendiary device according to claim 1, 3 or 4, wherein said incendiary composition consists of, in terms of percent by weight, ammonium perchlorate: 56 aluminum: 25 hydroxyl-terminated polybutadiene polymer cured with an isocyanate or diisocyanate: 18 thixotropic agent: 1.

8. A floating incendiary device according to claim 1, 3 or 4, additionally comprising delay igniter means including fuse means, whereby said firing means is activated on board an aircraft, said incendiary composition being ignited after landing of the device on the body of water.

9. A floating incendiary device for igniting a combustible material on the surface of a body of water, comprising an incendiary composition in the form of a disc having a burn time of about 2–2½ minutes at a temperature of about 1450° to 2300° C.

directing means in the form of a pair of thin plywood discs being slightly larger in diameter than said incendiary disc, bonded to and retaining said incendiary disc therebetween, wherein said incendiary and plywood discs are co-axially aligned;

flotation means in the form of a pair of cylindrical polystyrene foam flocks of the same diameter as said plywood discs bonded to the exposed major surfaces of said plywood discs; and firing means for igniting the incendiary disc peripherally, such that in operation the incendiary composition is maintained above the surface of the water in substantial alignment with the plane of the water and burns inwardly, the resulting flame being directed radially outwardly by said plywoods discs over the surface of the combustible material during the burn time of the incendiary composition.

10. A floating incendiary device according to claim 9, wherein said incendiary composition comprises in terms of percent by weight, ammonium perchlorate: 40–70 a fuel selected from magnesium and aluminum: 10–30 an hydroxy-terminated polybutadiene based binder: 14–22.

11. A floating incendiary device according to claim 9, wherein said incendiary composition consists of, in terms of percent by weight,

| | |
|---|---|
| ammonium perchlorate | 56 |
| aluminum | 25 |
| hydroxyl-terminated polybutadiene polymer cured with an isocyanate or diisocyanate | 18 |
| thixotropic agent | 1 |
| | 100 |

12. A floating incendiary device according to claim 9, 10 or 11, additionally comprising delay igniter means including fuse means, whereby said firing means is activated on board an aircraft, said incendiary composition being ignited after landing of the device on the body of water.

* * * * *